US007194198B2

(12) United States Patent
Lee

(10) Patent No.: US 7,194,198 B2
(45) Date of Patent: Mar. 20, 2007

(54) SAUNA FAR INFRARED HEAT EMITTING ARTICLE AND METHOD

(75) Inventor: Chang Hwan Lee, Cerritos, CA (US)

(73) Assignee: American Infrared Sauna Corp., Anaheim, CA (US)

( * ) Notice: Subject to any disclaimer, the term of this patent is extended or adjusted under 35 U.S.C. 154(b) by 0 days.

(21) Appl. No.: 11/008,535

(22) Filed: Dec. 9, 2004

(65) Prior Publication Data

US 2005/0133492 A1 Jun. 23, 2005

Related U.S. Application Data

(63) Continuation-in-part of application No. 10/449,850, filed on May 30, 2003, now abandoned.

(51) Int. Cl.
*F24C 7/00* (2006.01)

(52) U.S. Cl. ..... 392/407; 219/544; 250/493.1

(58) Field of Classification Search ..... 392/407–408, 392/432–439; 219/544, 553, 530, 540, 546, 219/548, 536; 250/493.1, 495.1, 504 R; 4/524, 526

See application file for complete search history.

(56) References Cited

U.S. PATENT DOCUMENTS

| | | | | | |
|---|---|---|---|---|---|
| 1,589,338 | A | * | 6/1926 | White | 219/528 |
| 2,816,201 | A | | 12/1957 | Mulvey | |
| 2,859,321 | A | | 11/1958 | Garaway | |
| 2,995,645 | A | | 8/1961 | Rankin, Jr. | |
| 3,153,138 | A | | 10/1964 | Goldstein | |
| 3,153,140 | A | | 10/1964 | Theodore et al. | |
| 3,564,200 | A | * | 2/1971 | Governale et al. | 392/435 |
| 3,582,614 | A | | 6/1971 | Zellers | |
| 3,648,299 | A | | 3/1972 | Durst | |
| 3,679,473 | A | | 7/1972 | Blatchford et al. | |
| 4,034,527 | A | | 7/1977 | Jalasjaa | |
| 4,415,798 | A | * | 11/1983 | Knappe | 392/435 |
| 4,455,319 | A | | 6/1984 | Clark | |
| 4,773,105 | A | | 9/1988 | Toyoshima | |
| 5,028,760 | A | | 7/1991 | Okuyama | |
| 5,117,481 | A | * | 5/1992 | Sung | 392/416 |
| 5,255,399 | A | | 10/1993 | Park | |
| 5,419,855 | A | * | 5/1995 | Kikuta | 252/587 |
| 5,607,609 | A | * | 3/1997 | Sakuyama et al. | 219/388 |
| 5,907,663 | A | * | 5/1999 | Lee | 392/407 |
| 6,294,769 | B1 | * | 9/2001 | McCarter | 219/544 |
| 6,497,717 | B1 | | 12/2002 | Daffer et al. | |
| 2001/0016115 | A1 | * | 8/2001 | Hirata et al. | 392/435 |

(Continued)

FOREIGN PATENT DOCUMENTS

| | | |
|---|---|---|
| DE | 31 19042 A1 | 12/1982 |

(Continued)

*Primary Examiner*—Thor S. Campbell
(74) *Attorney, Agent, or Firm*—Fulwider Patton LLP

(57) ABSTRACT

The present invention provides a far infrared heat emitting article for a sauna. The article includes a heating element, for emitting far infrared heat in the far infrared wavelength range. It also includes a supporting-encapsulating element, for supporting the heating element thereon and for encapsulating the heating element therein, able to distribute the far infrared heat substantially evenly thereover. The article further includes a heat-dispersing coating, extending over and coating the supporting-encapsulating element, able to substantially evenly disperse the emitted far infrared heat therefrom.

27 Claims, 9 Drawing Sheets

U.S. PATENT DOCUMENTS

2002/0046422 A1 4/2002 Perett

FOREIGN PATENT DOCUMENTS

| | | | |
|---|---|---|---|
| DE | 39 28581 A1 | | 3/1991 |
| GB | 2 195 530 A | | 4/1988 |
| JP | 57-191973 | * | 11/1982 |
| JP | 60-41789 | * | 3/1985 |
| JP | 61-106157 | * | 5/1986 |
| JP | 61-200682 | * | 9/1986 |
| JP | 63-292591 | * | 11/1988 |
| JP | 64-67887 | * | 3/1989 |
| JP | 1-217882 | * | 8/1989 |
| JP | 2-265188 | * | 10/1990 |
| JP | 3-127677 | * | 5/1991 |
| JP | 7-296946 | * | 11/1995 |
| JP | 8-187266 | * | 7/1996 |
| JP | 9-329341 | * | 12/1997 |

* cited by examiner

FIG. 8
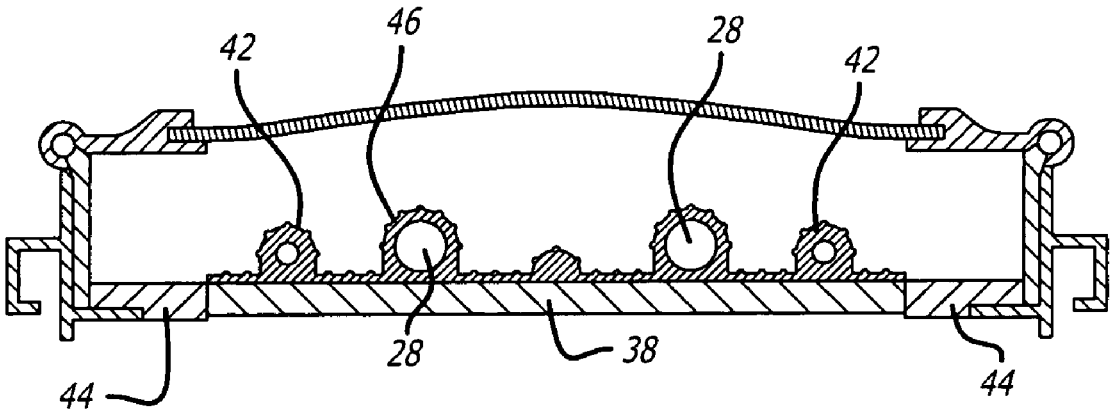
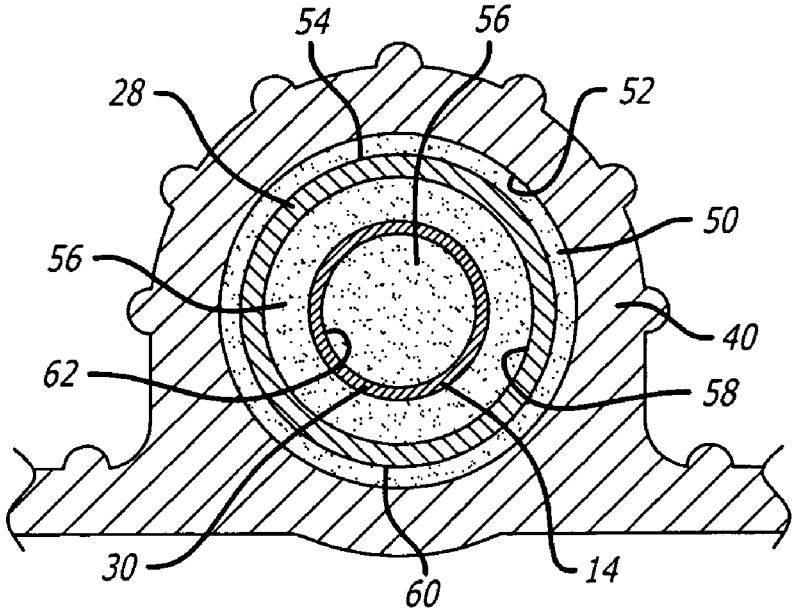
FIG. 9

SAUNA FAR INFRARED HEAT EMITTING ARTICLE AND METHOD

CROSS-REFERENCE TO RELATED APPLICATION

This application is a continuation-in-part of application Ser. No. 10/449,850, filed on May 30, 2003 now abandoned.

BACKGROUND OF THE INVENTION

1. Field of the Invention

This invention is generally related to far infrared heaters, and more particularly, to an article and method for emitting far infrared heat for a sauna.

2. General Background and State of the Art

It is known to provide conventional heaters for saunas which include a heating element including a resistor wire packed with silica sand, inside a steel tube. The heating element heats up the pipe. Rocks are placed on the heating element, producing infrared radiant heat by heating the rocks. Heat is provided by convection by superheating the air. Such heaters operated at reduced heater wattage to simulate the far infrared wavelength, but the small surface area thereof prevented generating the desired wavelength. Also, the infrared energy emitted thereby traveled in a straight line, which was inefficient. Further, such heaters took longer to generate heat and required substantial energy therefor.

Infrared heaters for saunas include a heating element inside a steel pipe, wherein the heating element includes a resistor wire packed in silica sand. The steel pipe is carbon coated to produce infrared heat. A reflector consisting of an aluminum or metal sheet is positioned behind the heater, to increase the heat generated and to produce heat evenly. However, the surface temperature of such heaters is very high, inhibiting the user from getting close thereto.

Ceramic heaters for producing infrared include a heating element inside a ceramic pipe, and include a reflector to produce heat evenly. Such heaters however also generate very high surface temperatures, and are very fragile.

It would therefore be desirable to provide an article which is capable of evenly disbursing far infrared heat for a sauna at a longer wavelength and a lower wattage, with reduced heat discharge and at a lower surface temperature.

Therefore, there has been identified a continuing need to provide an article which is capable of evenly disbursing far infrared heat for a sauna at a longer wavelength and a lower wattage, with reduced heat discharge and at a lower surface temperature.

INVENTION SUMMARY

Briefly, and in general terms, the present invention, in a preferred embodiment, by way of example, is directed to an article for emitting far infrared heat for a sauna. The article includes a heating element, for emitting far infrared heat in the far infrared wavelength range. It also includes a supporting-encapsulating element, for supporting the heating element thereon and for encapsulating the heating element therein, which is able to distribute the far infrared heat substantially evenly thereover. It further includes a heat-dispersing coating, extending over and coating the supporting-encapsulating element, which is able to substantially evenly disperse the emitted far infrared heat therefrom.

In accordance with other aspects of the invention, there is further provided an article wherein the heating element emits far infrared heat within the far infrared wavelength range of heat emitted by the human body.

In other aspects of the invention, the article emits a substantial amount of far infrared heat at a substantially low surface temperature, at a substantially long wavelength, and at a substantially low wattage, and enables sensing thereof by the user relatively rapidly.

In yet other aspects of the invention, the heating element comprises a hollow metal tube which includes a resistor wire therein, and alternatively comprises a hollow glass tube which includes a coil therein.

These and other aspects and advantages of the invention will become apparent from the following detailed description and the accompanying drawings, which illustrate by way of example the features of the invention.

BRIEF DESCRIPTION OF THE DRAWINGS

FIG. 8 is a cross-sectional view of the second embodiment of the far infrared heat emitting article;

FIG. 9 is a partly-fragmentary cross-sectional view of a projecting portion of a supporting-encapsulating element in the second embodiment of the invention;

DETAILED DESCRIPTION OF THE PREFERRED EMBODIMENTS

Figure 1:
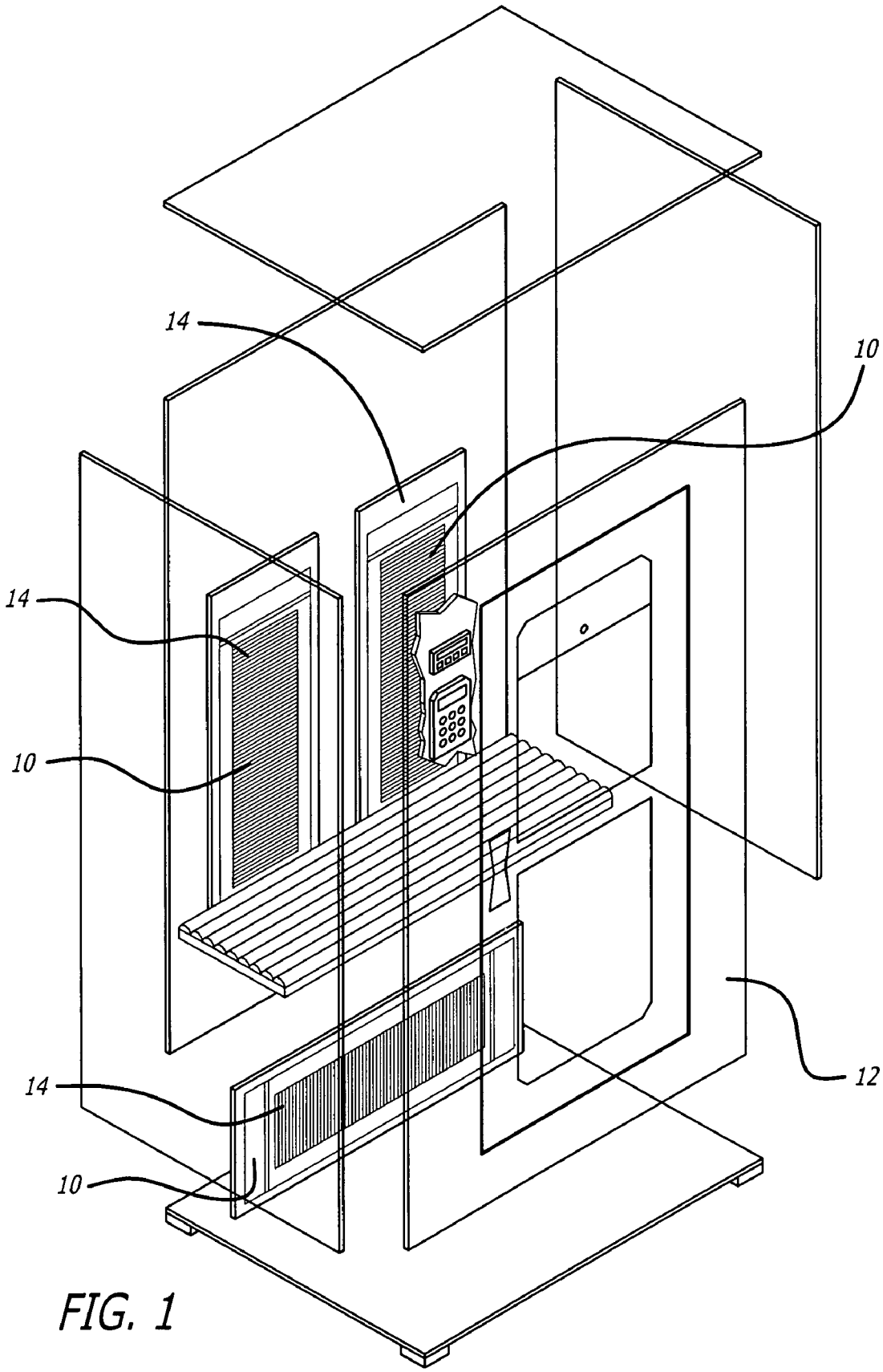
FIG. 1 is an exploded perspective view of a sauna including a first embodiment of multiple far infrared heat emitting articles in accordance with aspects of the present invention.
Figure 2:
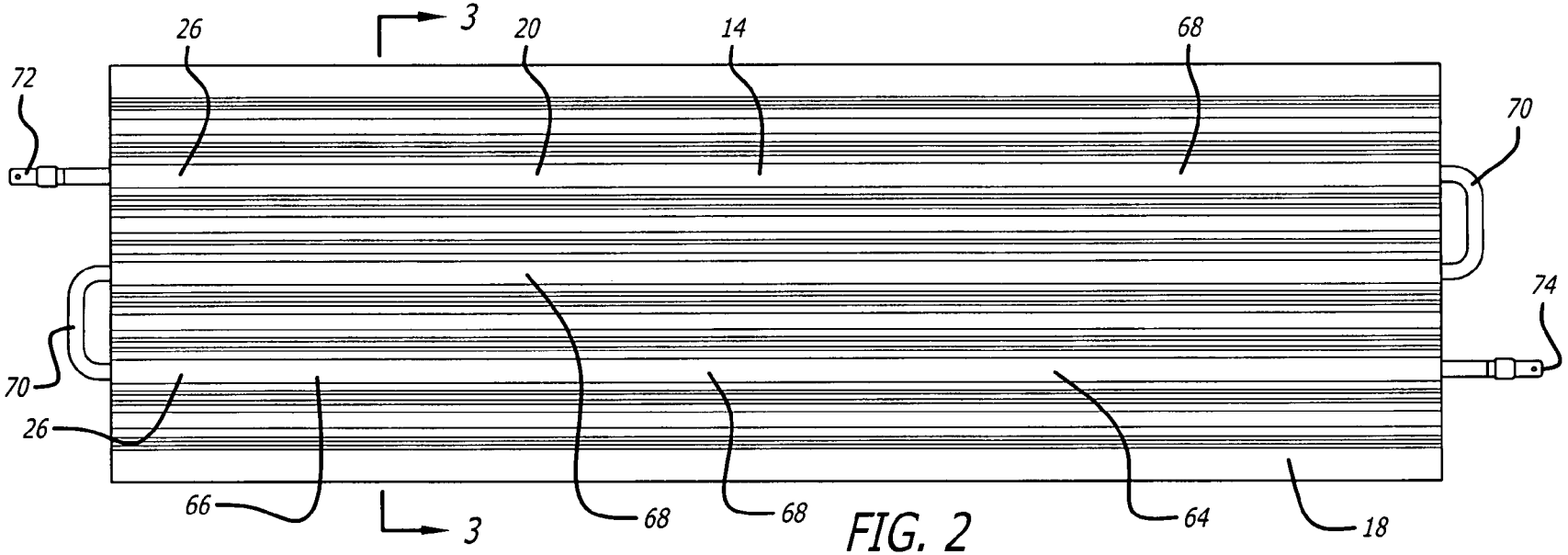
FIG. 2 is a front elevational view of the first embodiment of the far infrared heat emitting article.
Figure 3:
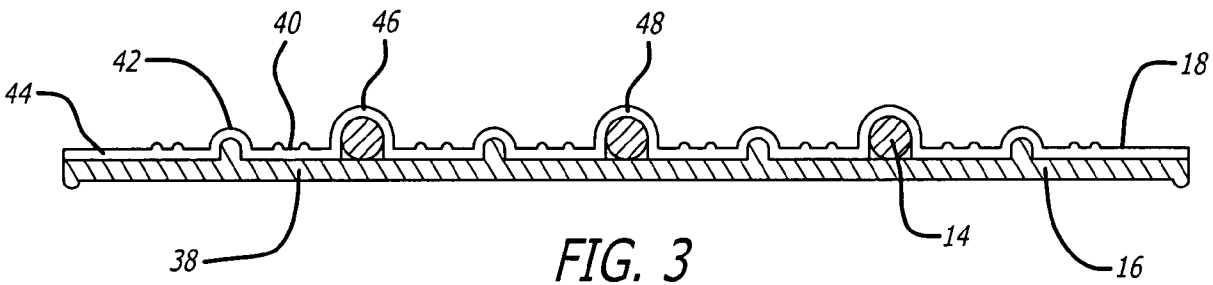
FIG. 3 is a cross-sectional view of the first embodiment of the far infrared heat emitting article.
Figure 4:
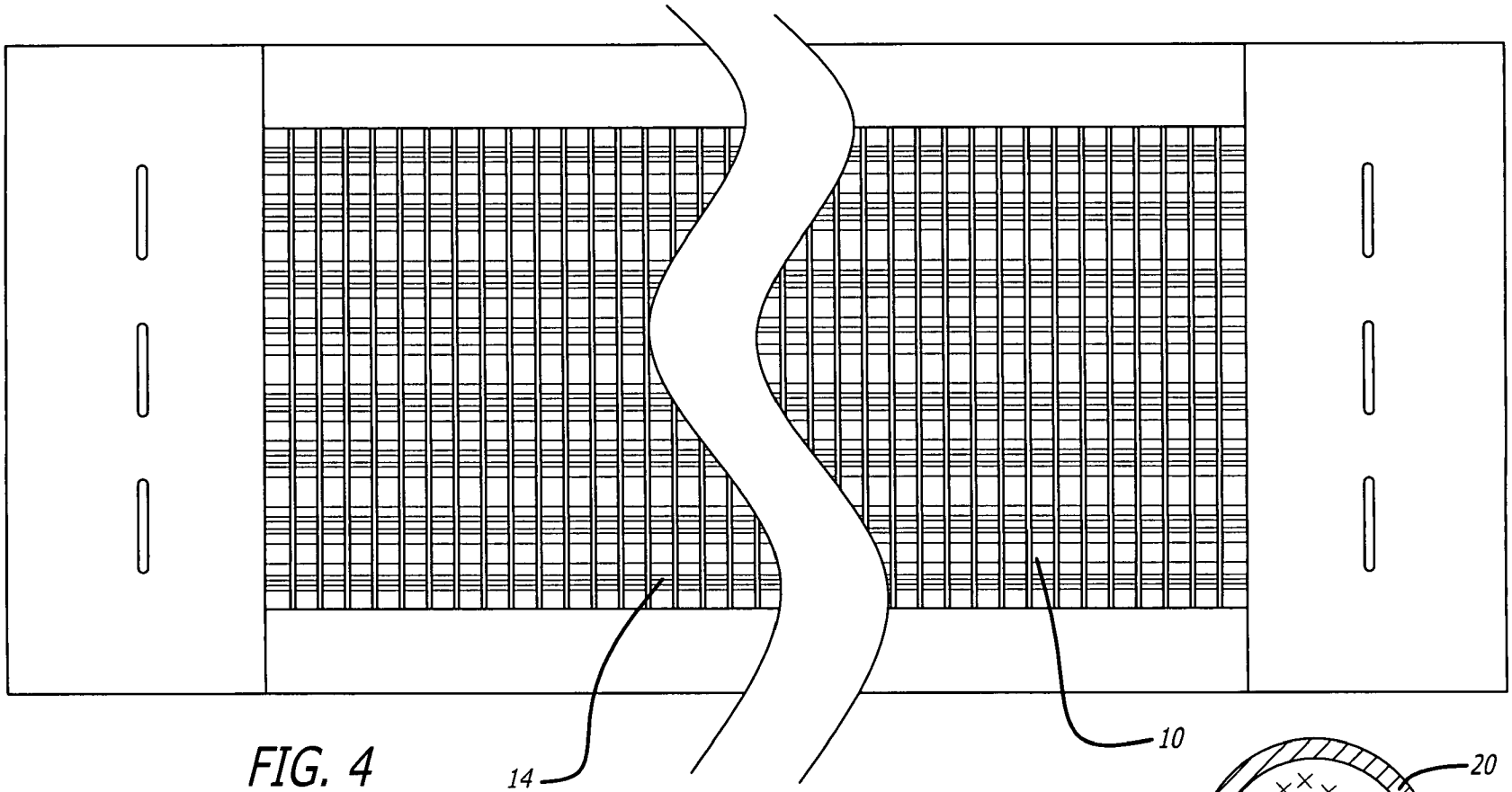
FIG. 4 is a front partly-fragmentary elevational view of the first embodiment of the far infrared heat emitting article in a housing.
Figure 5:
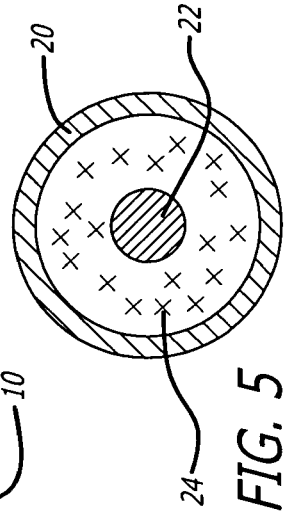
FIG. 5 is a cross-sectional view of a heating element for the first embodiment of the far infrared heat emitting article.

Referring to the drawings, in which like reference numerals refer to like or corresponding parts, the article 10 according to the invention emits far infrared heat for a sauna 12. FIGS. 1–5 and 7–13 present an article 10 in accordance with the invention which includes a heating element 14, for emitting far infrared heat in the far infrared wavelength range. Further, the article 10 includes a supporting-encapsulating element 16, for supporting the heating element 14 thereon and for encapsulating the heating element 14 therein, able to distribute the far infrared heat substantially evenly thereover. The article 10 also includes a heat-dispersing coating 18, extending over and coating the supporting-encapsulating element 16, and, able to substantially evenly disperse the emitted far infrared heat therefrom.

Figure 6:
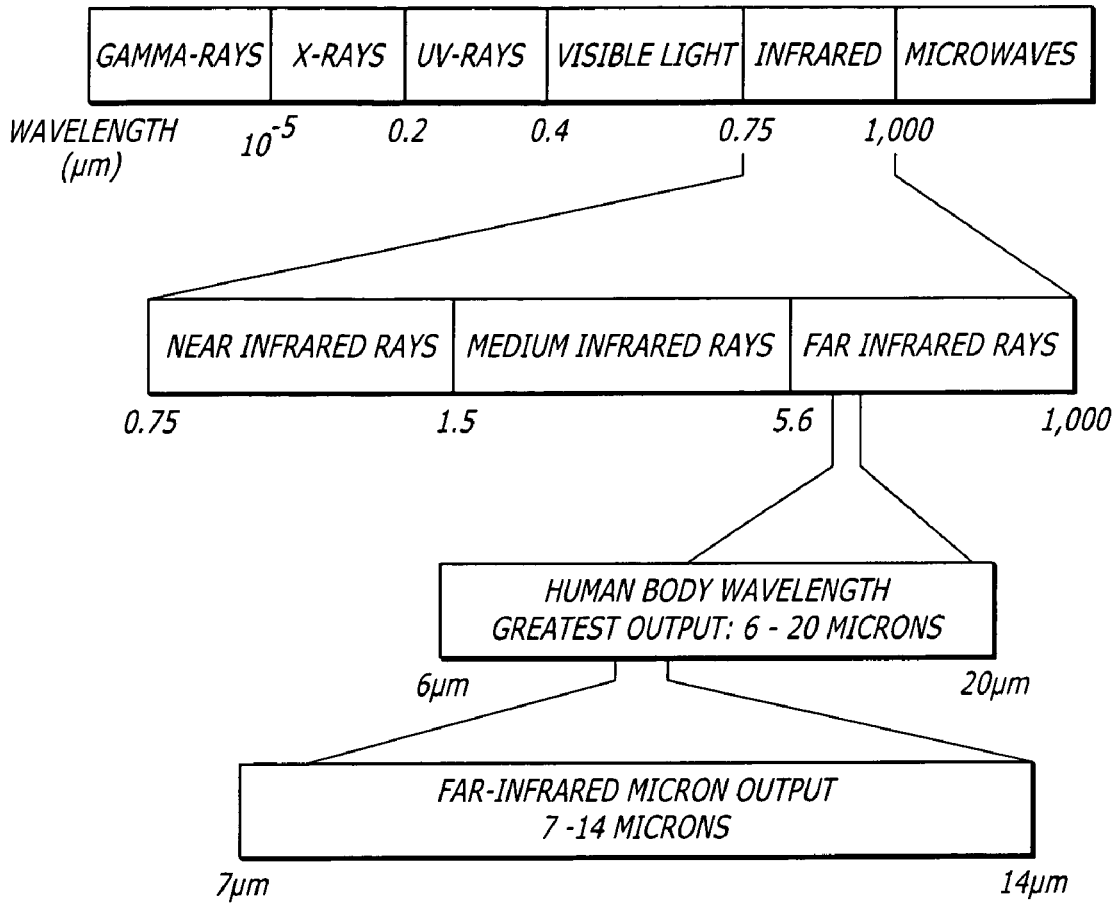
FIG. 6 is a chart of wavelengths including infrared, near, medium and far infrared rays, human body wavelength, and far-infrared micron output.
Figure 7:
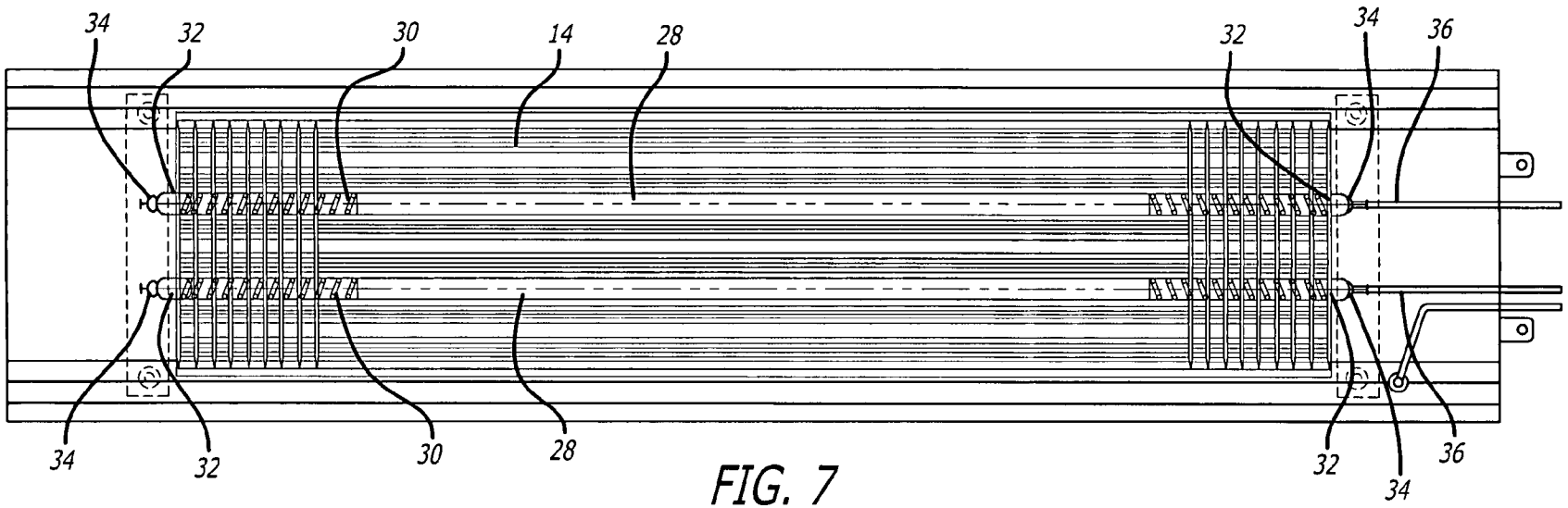
FIG. 7 is a front elevational view of a second embodiment of a far infrared heat emitting article.
Figure 10:
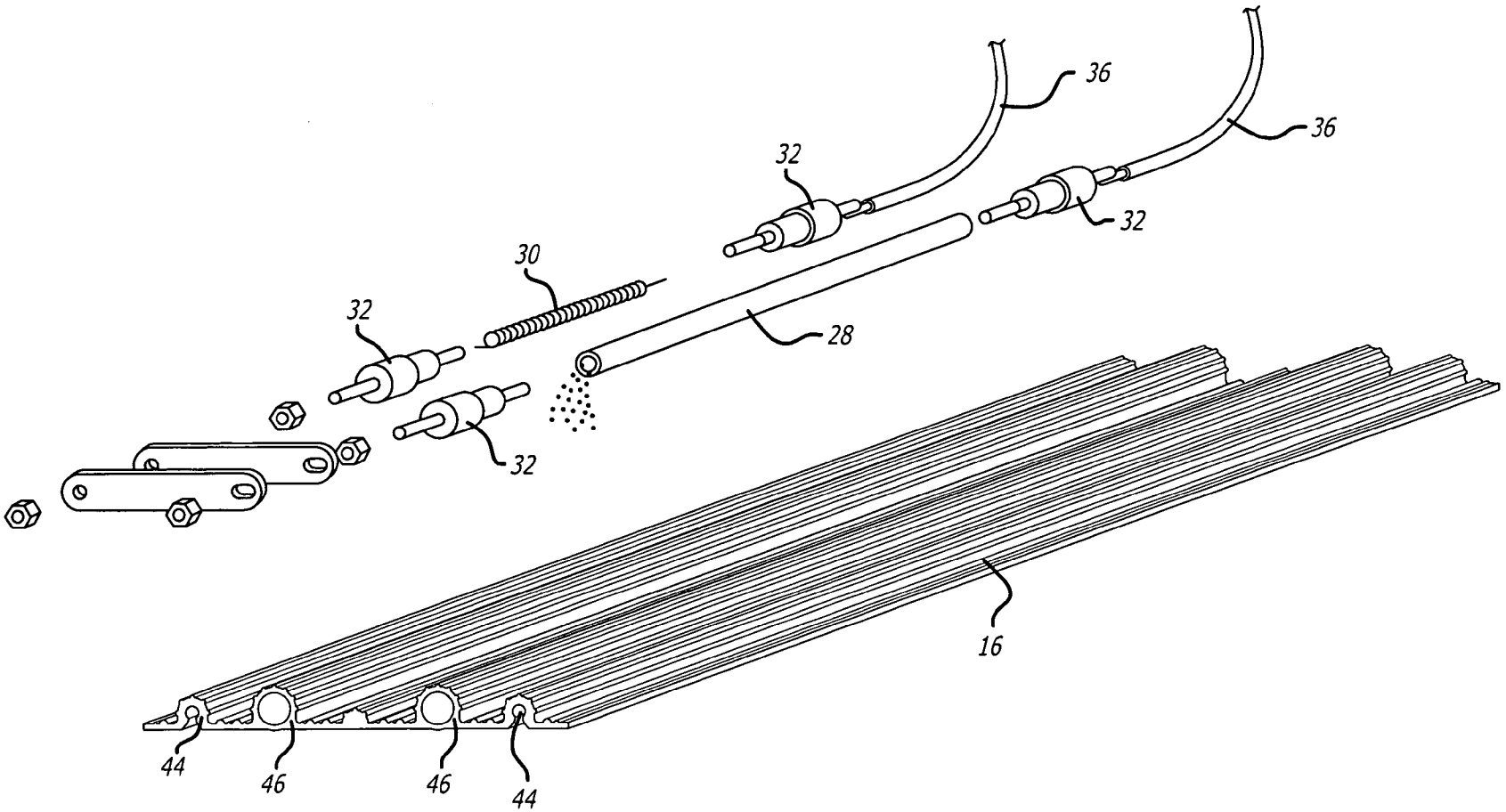
FIG. 10 is a partly-exploded perspective view of the second embodiment of the far infrared heat emitting article.
Figure 11:
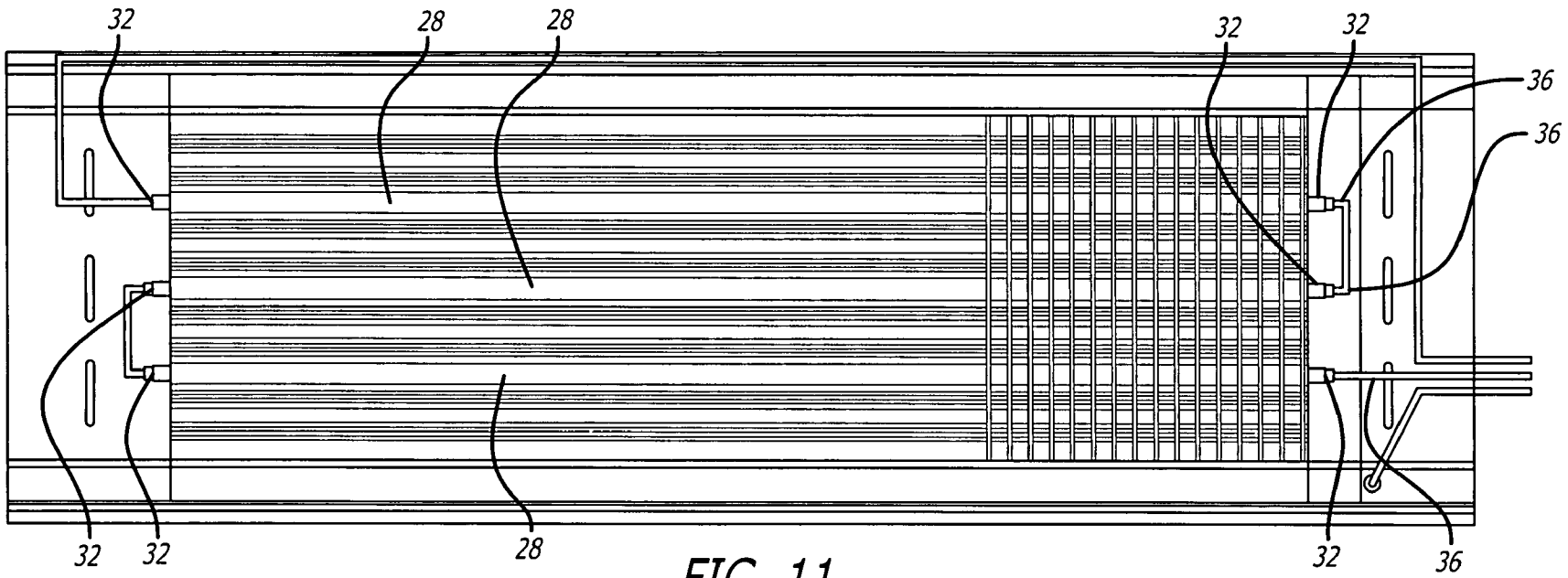
FIG. 11 is a front elevational view of a variation of the second embodiment of the far infrared heat emitting article.
Figure 12:
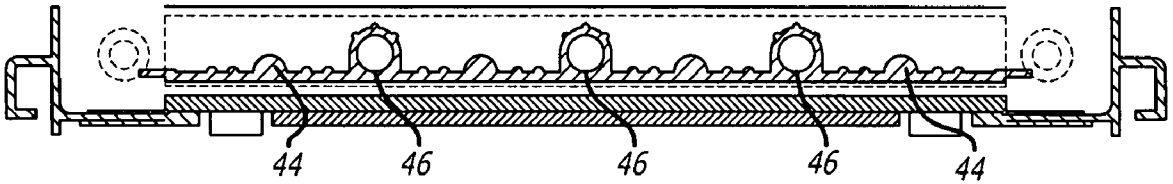
FIG. 12 is a cross-sectional view of the variation of the second embodiment of the far infrared heat emitting article.
Figure 13:
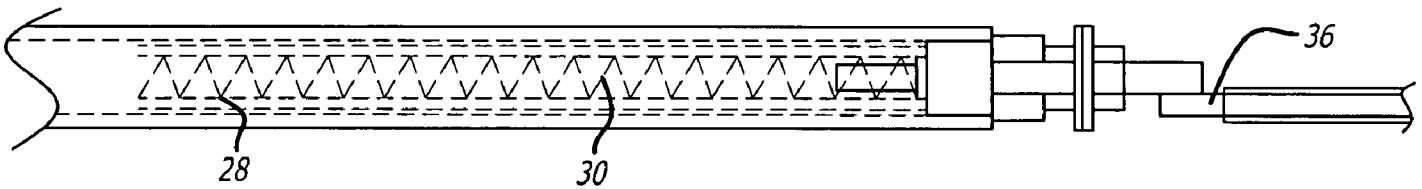
FIG. 13 is a partly fragmentary view of a glass tube heating element of the second embodiment of the far infrared heat emitting article.

Referring to FIG. 6, which is a chart of the wavelength ranges in microns from gamma rays to microwaves, and particularly infrared rays, the human body emits far infrared heat in the wavelength range of 6 to 20 microns. The heating element 14 of the article 10 emits far infrared heat in the wavelength range of 7 to 14 microns, within the human body wavelength range. The heating element 14 is able to emit far infrared heat at a substantially low surface temperature, to emit a substantial amount of far infrared heat, and to emit far infrared heat so as to be sensed by the user relatively rapidly. The heating element 14 is also able to emit far infrared heat at a substantially long wavelength, and to generate far infrared heat at a substantially low wattage.

FIGS. 1–5 show a first embodiment of the article 10, wherein the heating element 14 comprises a hollow tube 20, which includes a resistor wire 22 therein. The hollow tube 20 is comprised of metal. The resistor wire 22 is packed in silica sand 24 in the hollow tube 20. The heating element 14 comprises a plurality of spaced apart tubes 26 which extend in the supporting-encapsulating element 16. The plurality of spaced-apart tubes 26 may comprise two tubes, or three tubes. In the first embodiment of the article 10, the heating element 14 comprises a continuous metal element 64 which includes extending portions 66 which extend in the supporting-encapsulating element 16 in the form of a plurality of spaced-apart tubes 68, interconnecting portions 70 which interconnect the tubes 68 outside the supporting-encapsulating element 16, an inlet portion 72, and an outlet portion 74.

FIGS. 7–13 illustrate a second embodiment of the article 10 and a variation thereof, wherein the heating element 14 comprises at least one glass tube 28, for example two glass tubes 28 or three glass tubes 28, each of which includes a coil 30 therein. The glass tube 28 and the coil 30 in the glass tube 28 include ceramic coils 32 at the opposed ends 34 thereof, with a wire 36 extending from the ceramic coil 32 at one end 34 thereof. In the second embodiment of the article 10 and the variation thereof, the heating element 14 comprises separate glass tubes 28.

The supporting-encapsulating element 16 of the article 10 includes a base layer 38 for supporting the heating element 14, and an encapsulating layer 40 for encapsulating the heating element 14. The base layer 38 includes projecting portions 42 which are projecting therefrom, able to fan out and reflect the emitted far infrared heat. The supporting-encapsulating element 16 in the first embodiment of the article 10 may be comprised of metal. The encapsulating layer 40 includes extending portions 44 which extend over the base layer 38, and extending portions 46 which extend over the heating element 14. The extending portions 46 of the encapsulating layer 40 which extend over the heating element 14 include projecting portions 48. In the second embodiment of the article 10 and the variation thereof, the encapsulating layer 40 includes silica sand 50 between the inner surface 52 of the encapsulating layer 40 and the outer surface 54 of the glass tube 28, and the heating element 14 includes silica sand 56, between the inner surface 58 of the glass tube 28 and the outer surface 60 of the coil 30, and inside the inner surface 62 of the coil 30.

The heat-dispersing coating 18 is able to provide a substantial radiating surface area for the emitted far infrared heat. The heat-dispersing coating 18 is further able to discharge dispersed heat so as to reduce the heat discharge in the supporting-encapsulating element 16.

To use the article 10 of the present invention, as shown in FIGS. 1–5, the method includes emitting far infrared heat for a sauna 12. Also, the method includes supporting and encapsulating the heating element 14, by the supporting-encapsulating element 16, for enabling the article to distribute the far infrared heat in the far infrared wavelength range emitted by the heating element 14 substantially evenly over the supporting-encapsulating element 16. The method further includes coating the supporting-encapsulating element 16, by the heat-dispersing coating 18, for enabling the article 10 to emit far infrared heat in the far infrared wavelength range, and to substantially evenly disperse the emitted far infrared heat. The method further comprises surface mounting the article 10 in the sauna 12.

Emitting far infrared heat includes emitting through the metal heating element 14, in the wavelength range of 7 to 14 microns within the wavelength range of 6 to 20 microns of far infrared heat emitted by the human body. It also includes emitting far infrared heat at a substantially low surface temperature, emitting a substantial amount of far infrared heat, and emitting far infrared heat so as to be sensed by the user relatively rapidly. Further, emitting includes emitting far infrared heat at a substantially long wavelength, and generating far infrared heat at a substantially low wattage. It further includes emitting far infrared heat by the resistor wire 22 packed in silica sand 24 in the hollow tube 20.

Emitting far infrared heat also includes emitting through the plurality of spaced apart tubes 68 extending in the supporting-encapsulating element 16, which spaced apart tubes 68 may comprise two tubes or three tubes. It further includes emitting far infrared heat through the plurality of spaced-apart tubes 68 of the extending portions 66, the interconnecting portions 70, the inlet portion 72, and the outlet portion 74 of the continuous element 64 of the heating element 14. Emitting far infrared heat includes emitting through the coil 30 and the glass tube 28 of the heating element 14, which glass tube 28 and the coil 30 therein include the ceramic coils 32 at the opposed ends 34 thereof, and the wire 36 extending from the ceramic coil 32 at one end 34 thereof.

Supporting and encapsulating the heating element 14 includes supporting the heating element 14 in the base layer 38, including the projecting positions 42 which project therefrom, so as to fan out and reflect the emitted far infrared heat, and encapsulating the heating element 14 in the encapsulating layer 40. Supporting and encapsulating comprises supporting and encapsulating in the metal supporting-encapsulating element 16. Supporting and encapsulating includes supporting on the base layer 38 and encapsulating in the encapsulating layer 40 by portions thereof extending over the base layer 38 and portions thereof extending over the heating element 14, which include extending portions 46 extending over the heating element 14. It also includes encapsulating in the encapsulating layer 40, which includes silica sand 50 between the inner surface 52 of the encapsulating layer 40 and the outer surface 54 of the glass tube 28, and encapsulating the heating element 14, which includes silica sand 50 between the inner surface 58 of the glass tube 28 and the outer surface 60 of the coil 30, and inside the inner surface 62 of the coil 30.

Coating the supporting-encapsulating element further includes providing a substantial radiating surface for the emitted far infrared heat by the heat-dispersing coating 18. Coating further includes reducing the heat discharge in the supporting-encapsulating element 16 by discharging dispersed heat, by the heat-dispersing coating 18. Coating comprises coating the supporting-encapsulating element 16 by the ceramic heat-dispersing coating 18.

While the particular far infrared heat emitting article as shown and disclosed in detail herein is fully capable of obtaining the objects and providing the advantages previously stated, it is to be understood that it is merely illustrative of the presently preferred embodiment of the invention, and that no limitations are intended to the details of construction or design shown herein other than as described in the appended claims.

I claim:

1. An article for emitting far infrared heat for a sauna, comprising:

a heating element, for emitting far infrared heat in the far infrared wavelength range;

a supporting-encapsulating element, for supporting the heating element thereon and for encapsulating the heating element therein, able to distribute the far infrared heat substantially evenly thereover including an encapsulating layer for encapsulating the heating element, and a base layer for supporting the heating element, wherein the encapsulating layer and the base layer follow the contours of, and extend against, the heating element, so as to seal the heating element between the encapsulating layer and the base layer; and a heat-dispersing coating, extending over and coating the supporting-encapsulating element, able to substantially evenly disperse the emitted far infrared heat therefrom.

2. The article as in claim 1, wherein the heating element emits far infrared heat in the wavelength range of 7 to 14 microns.

3. The article as in claim 1, wherein the far infrared wavelength range of heat emitted thereby is within the far infrared wavelength range of heat emitted by the human body.

4. The article as in claim 1, wherein the heating element is able to emit far infrared heat at a substantially low surface temperature.

5. The article as in claim 1, wherein the heating element is able to emit a substantial amount of far infrared heat.

6. The article as in claim 1, wherein the heating element is able to emit far infrared heat so as to be sensed by the user relatively rapidly.

7. The article as in claim 1, wherein the heating element is able to emit far infrared heat at a substantially long wavelength, and to generate far infrared heat at a substantially low wattage.

8. The article as in claim 1, wherein the heating element comprises a hollow tube, which includes a resistor wire therein.

9. The article as in claim 1, wherein the supporting-encapsulating element is comprised of metal.

10. The article as in claim 1, wherein the heat-dispersing coating is further able to provide a substantial radiating surface area for the emitted far infrared heat.

11. The article as in claim 1, wherein the heat-dispersing coating is further able to discharge dispersed heat so as to reduce the heat discharge in the supporting-encapsulating element.

12. The article as in claim 1, wherein the heat-dispersing coating is comprised of ceramic.

13. The article as in claim 1, further able to be surface mounted in the sauna.

14. The article as in claim 1, wherein the supporting-encapsulating element comprises a base layer, and an encapsulating layer which includes portions extending over the base layer and portions extending over the heating element.

15. The article as in claim 1, wherein the heating element comprises a plurality of spaced apart tubes which extend in the supporting-encapsulating element.

16. An article for emitting far infrared heat for a sauna, comprising:

a heating element, for emitting far infrared heat in the far infrared wavelength range, which comprises a continuous element which includes extending portions which extend in the supporting-encapsulating element in the form of a plurality of spaced-apart tubes, interconnecting portions which interconnect the tubes outside the supporting-encapsulating element, an inlet portion, and an outlet portion;

a supporting-encapsulating element, for supporting the heating element thereon and for encapsulating the heating element therein, able to distribute the far infrared heat substantially evenly thereover; and a heat-dispersing coating, extending over and coating the supporting-encapsulating element, able to substantially evenly disperse the emitted far infrared heat therefrom.

17. The article as in claim 1, wherein the heating element comprises a glass tube, which includes a coil therein.

18. The article as in claim 1, wherein the heating element of the article emits far infrared heat in the wavelength range of 7 to 14 microns.

19. The article as in claim 8, wherein the hollow tube is comprised of metal.

20. The article as in claim 8, wherein the resistor wire is packed in silica sand in the hollow tube.

21. The article as in claim 1, wherein the base layer includes projecting portions which are projecting therefrom, able to fan out and reflect the emitted far infrared heat.

22. The article as in claim 14, wherein the portions of the encapsulating layer extending over the heating element include projecting portions.

23. The article as in claim 14, wherein the encapsulating layer includes silica sand between the inner surface of the encapsulating layer and outer surface of the glass tube, and the heating element includes silica sand between the inner surface of the glass tube and the outer surface of the coil, and inside the inner surface of the coil.

24. The article as in claim 15, wherein the plurality of spaced-apart tubes comprise two tubes.

25. The article as in claim 15, wherein the plurality of spaced-apart tubes comprise three tubes.

26. The article as in claim 17, wherein the glass tube and the coil in the glass tube include ceramic coils at the opposed ends thereof, with a wire extending from the ceramic coil at one end thereof.

27. An article for emitting far infrared heat for a sauna, comprising:

heating means, for emitting far infrared heat in the far infrared range;

supporting-encapsulating means, for supporting the heating element thereon and for encapsulating the heating means therein, adapted to distribute the far infrared heat substantially evenly thereover; and heat-dispersing means, for coating the supporting-encapsulating means, adapted to substantially evenly disperse the emitted far infrared heat therefrom.

* * * * *